United States Patent [19]

Aronson

[11] 4,445,547

[45] May 1, 1984

[54] LACING WIRE STOP MECHANISM FOR A COIL SPRING ASSEMBLY MACHINE

[75] Inventor: Terry L. Aronson, Pell Lake, Wis.

[73] Assignee: Leggett & Platt, Incorporated, Carthage, Mo.

[21] Appl. No.: 300,813

[22] Filed: Sep. 10, 1981

[51] Int. Cl.[3] ..... B21F 21/00

[52] U.S. Cl. ..... 140/92.3; 226/25; 226/45; 83/64

[58] Field of Search ..... 140/92.9, 92.93, 92.94, 140/92.7, 92.3, 92.4, 92.8; 72/4, 5, 17, 3; 192/125 A; 226/25, 45; 83/64, 65, 209, 210

[56] References Cited

U.S. PATENT DOCUMENTS

| | | | |
|---|---|---|---|
| 2,480,781 | 8/1949 | Simpson | 83/209 |
| 2,840,118 | 6/1958 | Gail | 140/92.8 |
| 3,122,177 | 2/1964 | Kamp . | |
| 3,212,377 | 10/1965 | Bennett | 83/210 |
| 3,451,443 | 6/1969 | Spühl | 140/92.7 |
| 3,503,115 | 3/1970 | Kirchner . | |
| 3,541,828 | 11/1970 | Norman . | |
| 4,112,726 | 9/1978 | Adams et al. | 72/137 |

*Primary Examiner*—Leon Gilden
*Assistant Examiner*—Linda McLaughlin
*Attorney, Agent, or Firm*—Wood, Herron & Evans

[57] ABSTRACT

A stop mechanism operative to stop a sprial lacing wire if the lacing wire encounters an obstacle as it is being wound in lacing fashion about juxtaposed end loops of coil springs in two adjacent coil spring rows, and after the lacing wire has completely laced together those two spring rows. A sensor functions to sense when the spiral lacing wire encounters an obstacle in its lacing path, the sensor incorporating a proximity switch that cooperates with a bowed guide element. The bowed guide element induces the lacing wire to pop out or bow away from the switch when the obstacle is encountered, activation of the switch causing the lacing wire to stop at once in its lacing path. A clamp device cooperates with a feeder switch to clamp the unlaced spiral lacing wire between its jaws when the feeder switch is activated by the lacing wire's lead end after the lacing wire has traversed the entire length of the adjacent rows.

14 Claims, 5 Drawing Figures

LACING WIRE STOP MECHANISM FOR A COIL SPRING ASSEMBLY MACHINE

This invention relates to coil spring assembly machines. More particularly, this invention relates to a lacing wire stop mechanism for a coil spring assembly machine.

It is well known to the prior art to fabricate a coil spring assembly by connecting adjacent coil spring rows of that assembly together through use of spiral lacing wires. Such coil spring assemblies are often used to form the spring cores for inner spring mattresses. In this product environment the coil springs of adjacent spring rows are connected together by spiral lacing wires in the top plane as well as the bottom plane of the assembly.

Also well known to the prior art are coil spring assembly machines by which adjacent rows of coil springs are connected one to the other by spiral lacing wires. In a typical assembly machine of this type, each of the upper and lower spiral lacing wires is initially formed by a lacing wire forming apparatus, and is thereafter caused to wind or travel or lace its way from one side edge of the coil spring assembly toward the other side edge thereof, for connecting together adjacent spring rows of the assembly. One recently invented coil spring assembly machine which functions to assemble adjacent spring rows into an interconnected coil spring assembly is illustrated in U.S. patent application Ser. No. 300,995, filed Sept. 10, 1981, and assigned to the assignee of this application. Lacing wire forming apparatus which takes a spring wire and coils it into a lacing spiral configuration, and thereafter causes that lacing spiral to wind to travel or lace its way from one side edge of the coil spring assembly toward the other side edge thereof, is disclosed in one or more of U.S. Pat. Nos. 3,122,177, 3,503,115, and 3,541,828.

There is one significant problem that periodically occurs during use of prior art coil spring assembly machines where adjacent coil spring rows are interconnected by spiral lacing wires. Prior to lacing of adjacent coil spring rows one to the other, the adjacent rows are clamped together by dies which cooperate with the adjacent springs' end loops. The dies also cooperate to define a travel path for the lacing wire as it travels from one edge to the other edge of the spring assembly. During use, and as the lacing wire proceeds from one edge to the other edge of the adjacent rows, occasionally the lacing wire encounters an obstacle of some kind intermediate those two edges, i.e., prior to completion of the lacing step for those two rows. This obstacle most often arises because the lacing wire's leading end somehow becomes hung up or stuck in its travel path through the coil spring assembly machine's dies as it traverses the adjacent spring rows from one side edge to the other side edge of the assembly. Further, and when the lacing wire's leading end reaches the other edge of the coil spring rows, it most definitely does meet an obstacle in the form of an end stop. In both these situations, i.e., whether the lacing wire's leading end encounters an obstacle as it proceeds from one side edge to the other side edge of the adjacent rows, or whether it proceeds until it has been laced around all adjacent coil springs within the adjacent rows so that it encounters the end stop, it is absolutely necessary that the lacing wire forming and feeding apparatus be shut down very quickly when the obstacle or end stop is encountered. Such quick shut down is necessary, of course, to prevent significant maintenance problems to the equipment, as well as to prevent significant reject problems in product being manufactured. One such lacing wire stop mechanism for a coil spring assembly machine is known to the art, see, U.S. Pat. No. 3,451,443, but this mechanism is relatively complex and difficult to install relative to the lacing wire stop mechanism of this invention.

Therefore, it has been one objective of this invention to provide an improved lacing wire stop mechanism for a coil spring assembly machine, that mechanism being less complex and easier to install relative to mechanisms known to the prior art, thereby providing an improved mechanism at less cost which requires minimum maintenance for, and which minimizes downtime of, the coil spring assembly machine.

It has been another objective of this invention to provide an improved lacing wire stop mechanism for a coil spring assembly machine, that mechanism including a novel sensitive sensor which functions by inducing the sprial lacing wire to jump out or pop out of its normal travel path instantaneously upon encountering an obstacle as it laces adjacent coil spring rows together.

Still a further objective of this invention has been to provide an improved lacing wire stop mechanism for a coil spring assembly machine, that mechanism incorporating a clamp device which automatically clamps the spiral lacing wire section adjacent the entry of the lacing wire with the coil spring assembly when the lacing of adjacent rows has been completed, thereby permitting the lacing wire to be cut adjacent the assembly's near edge without allowing the adjacent lacing wire section to spring forward into the assembly as a consequence of built up torque which remains in that lacing wire section.

In accord with these objectives, the improved lacing wire stop mechanism for a coil spring assembly machine includes a very sensitive sensor operative to sense when the spiral lacing wire encounters an obstacle in the course of being wound in lacing relation from one edge to the other edge of adjacent rows of spring coils. The sensor includes a proximity switch located adjacent to a bowed guide element. The spiral lacing wire normally traverses the bowed guide element as it is directed from the spiral lace forming apparatus into lacing relation with the juxtaposed spring rows. The bowed guide element defines a bowed path section which the spiral lacing wire is caused to follow. And because of this preliminary bowing imparted to the spiral lacing wire, the lacing wire is induced to pop out or jump out of the guide element away from the proximity switch in the event that the lacing wire encounters an obstacle in the course of moving through the clamping dies and around the juxtaposed end loops of the spring coils' rows. When the proximity switch is activated, a brake mechanism is operated to stop the helical lacing wire forming and feeding apparatus until the obstacle is removed or corrected. This sensor is simple of structure, and is easy to install and to maintain. It is also sensitive enough to perform the sensor function for which it is intended. The improved lacing wire stop mechanism for a coil spring assembly machine also includes a novel clamp device. The clamp device is operative to clamp the helical lacing wire adjacent the coil spring assembly's near edge prior to cut off. As a result, after cut off the loose end of the helical lacing wire does not spring forward into the assembly as a consequence of built up torque which remains in the lacing wire's loose end.

This clamp device eliminates a common problem which has existed with prior art lacing wire mechanisms. Heretofore, and whenever a lacing wire was cut off after being wound through adjacent rows of coil springs, the built up torque in the remainder of the unlaced but coiled lacing wire caused that unlaced wire to spring forward after cut off into the coil spring assembly where it often caused a jam when the coil spring assembly was subsequently indexed forward. The stop mechanism of this invention eliminates that potential jam problem.

Other objectives and advantages of this invention will be more apparent from the following detailed description taken in conjunction with the drawings in which.

Figure 1:
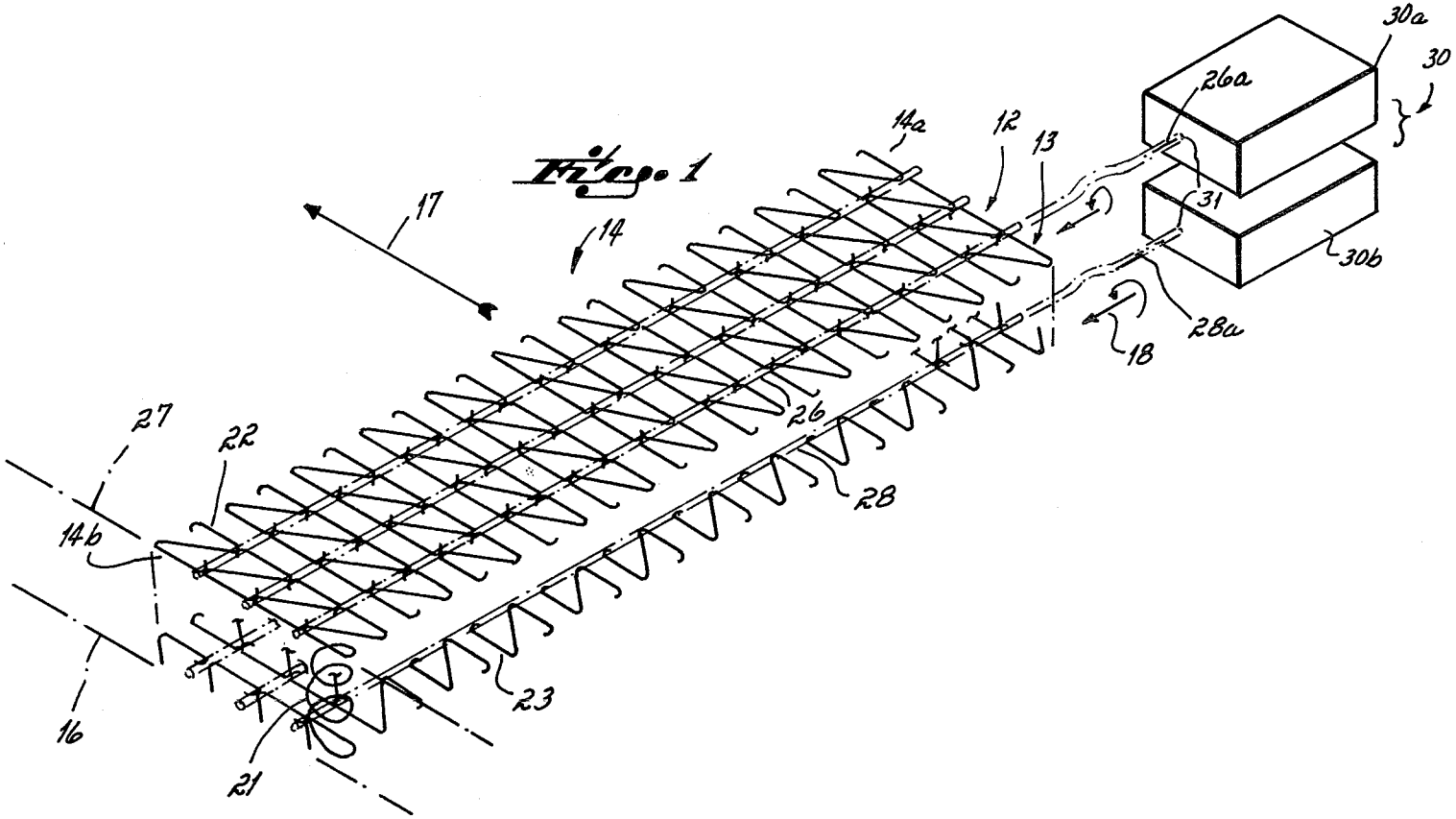
FIG. 1 is a perspective diagrammatic view illustrating the joiner of a coil spring assembly's adjacent coil spring rows, in both top and bottom planes, by spiral lacing wires.

The lacing wire stop mechanism 10 of this invention is particularly adapted for use with a coil spring assembly machine 11. The structure and operation of the lacing stop mechanism 10 shown in the figures is illustrated in connection with leading 12 and trailing 13 coil rows of a coil spring assembly 14. Each row 12, 13 of coils may comprise individual or separate coil springs (not shown), or may be (as shown in the figures) a continuous spring row manufactured by the machine and method shown in U.S. Pat. No. 4,112,726. The coil spring assembly machine 11 itself with which the lacing wire stop mechanism 10 of this invention is particularly adapted to cooperate is more particularly shown in pending U.S. patent application Ser. No. 300,995, filed Sept. 10, 1981, entitled "Coil Spring Assembly Machine", assigned to the assignee of this application, and the disclosure and description of the machine in that application is herein incorporated by reference.

Figure 2:
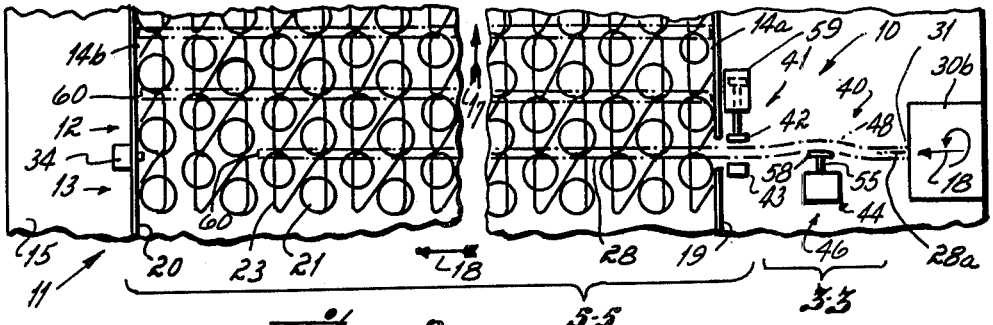
FIG. 2 is a top view similar to FIG. 1, but illustrating diagrammatically the components of the improved lacing wire stop mechanism in accord with the principles of this invention.
Figure 5:
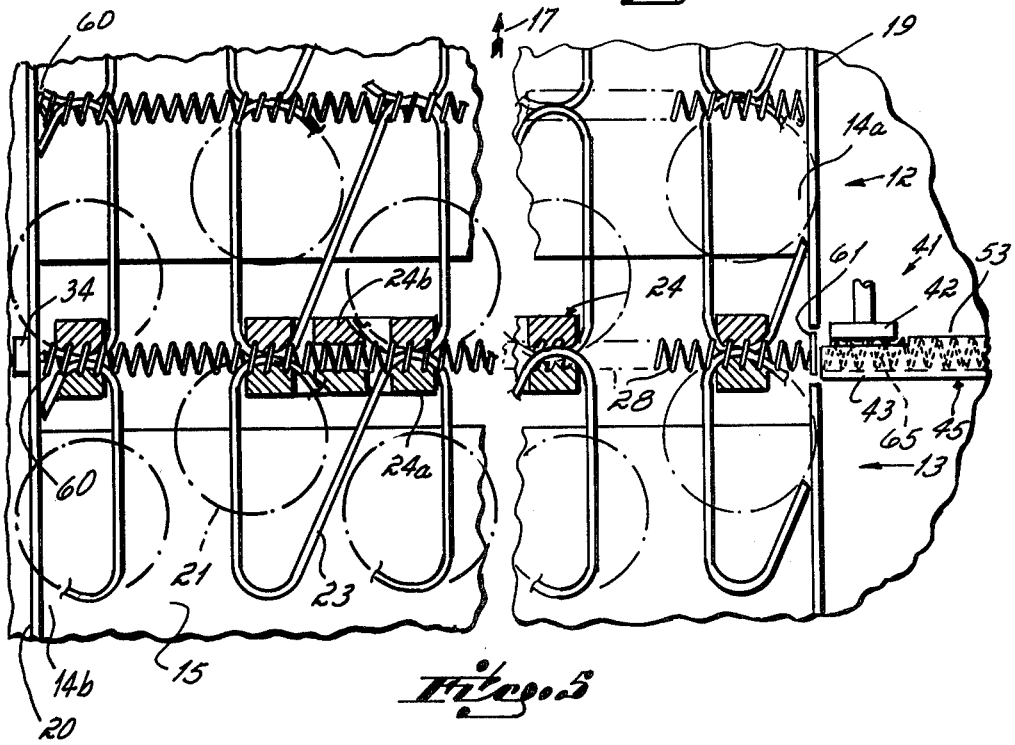
FIG. 5 is an enlarged and more detailed view of the bracketed area 5—5 of FIG. 2.

The basic components of the coil spring assembly machine 11, as shown in FIGS. 2 and 5, include a support platen 15 which defines a horizontal spring support plane 16. The coil spring assembly 14 is periodically indexed in the machine direction, as shown by arrow 17, along that support platen 15 after adjacent spring rows 12, 13 have been laced together. The spring assembly 14 is guided along the platen 15, i.e., is prevented from moving in the cross machine direction, as shown by arrow 18, by inner side edge rail 19 and by outer side edge rail 20 fixed to the support platen. The continuous spring rows 12, 13 shown in FIG. 1 are comprised of separate coil springs 21 each which is made from a continuous length of spring wire. The springs 21 within each row 12, 13 are connected by alternate upper 22 and lower 23 end loops throughout the length of the row. The coil spring assembly machine 11 also includes upper and lower dies, only the lower dies 24 being shown in FIG. 5, which cooperate with the upper 22 and lower 23 end loops of the springs 21. The upper dies, however, are identical in function and structure to the dies 24. When in the clamping position, the clamping dies' front dies **24*a* and the clamping dies' rear dies 24*b* are closed as shown in FIG. 5 for properly positioning and clamping together the juxtaposed end loops 22 of the springs 21 within the leading 12 and trailing 13 spring rows. It is in this die 24 closed position shown in FIG. 5, therefore, that the end loops 22 of the juxtaposed leading and trailing coil spring rows 12, 13 are laced together by an upper spiral lacing wire 26 (FIG. 1) so as to connect or tie the leading spring row to the trailing spring row in the upper plane 27 of the spring assembly 14. A lower spiral lacing wire 28 is similarly installed to connect or tie the leading spring row 12 to the trialing spring row in the lower plane 16 of the spring assembly 14**.

The lacing wire stop mechanism 10 for the coil spring assembly machine 11 cooperates with the lacing wire forming and feeding apparatus 30 of any type well known to the prior art. This type apparatus 30 takes a spring wire and coils it into a lacing coil configuration (see, e.g., U.S. Pat. Nos. 3,541,828 and 3,122,177 the disclosure and description of which are incorporated herein by reference), and thereafter causes that spiral lacing wire to wind or travel or lace its way from the near side edge **14*a* of the coil spring assembly toward the far side edge 14*b* thereof (see, e.g., U.S. Pat. No. 3,503,115, the disclosure and description of which are incorporated herein by reference). As the spiral lacing wires 26, 28 traverse the juxtaposed spring rows 12, 13, and as shown in FIG. 5, the spiral lacing wires are guided in either the assembly's upper plane 27 by the upper clamping dies (not shown) and in lower plane 16 by clamping the dies 24 for interconnecting juxtaposed Z-shaped end loops 22, 23 in the upper plane and in the lower plane of the adjacent coil spring rows. Particularly as shown in FIG. 2, the spiral lacing wire moves in a cross machine direction shown by arrow 18 from the assembly's near side edge 14*a* (i.e., near to the lacing wire forming apparatus 30) toward the far side edge 14*b* of those rows which it is connecting so as to tie together the adjacent continuous spring rows 12, 13. In each of the upper plane 27 and the lower plane 16 of adjacent coil spring rows 12, 13, note particularly that the lacing coil forming apparatus 30 is positioned so that the forming apparatus' outlet 31 lies on a linear axis 26*a*, 28*a* is established by the prospective laced joint defined by the clamping dies. One lacing wire forming and feeding apparatus 30*a* is provided for the top lacing wire 26 and another lacing wire forming and feeding apparatus 30*b* is provided for the lower spiral lacing wire 28 as shown in FIG. 1. Similarly, separate lacing wire stop mechanisms 10 in accord with the principles of this invention are provided to cooperate with the upper spiral lacing wire 26 and the lower spiral lacing wire 28**, although the description below is in connection with the lacing wire stop mechanism for the upper spiral lacing wire only.

The lacing wire stop mechanism 10 is operative to stop the helical lacing wire 26 in the event that the wire encounters an obstacle in the course of being wound in lacing fashion about the spring's juxtaposed end loops 23 as it traverses the rows 12, 13 from end edge **14*a* to end edge 14*b*. The stop mechanism 10 is positioned between the lacing coil forming and feeding apparatus 30 and the near side 14*a* of the coil spring assembly 14. The lacing wire stop mechanism 10 includes a sensor 40 that functions to sense when and if the helical lacing wire 28 is encountering an obstacle as it is wound or laced onto the end loops 23 of coil springs 21 in adjacent spring rows 12, 13. The lacing wire stop mechanism 10 also includes a clamp device 41 adjacent the assembly's near edge 14***a* that functions to clamp the non-laced portion 65 of the helical lacing wires 28 between its jaws 42, 43 after the lacing wire has completely laced the adjacent spring rows 12, 13 together.

Figure 4:
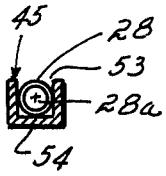
FIG. 4 is a cross-sectional view taken along line 4—4 of FIG. 3.
Figure 3:
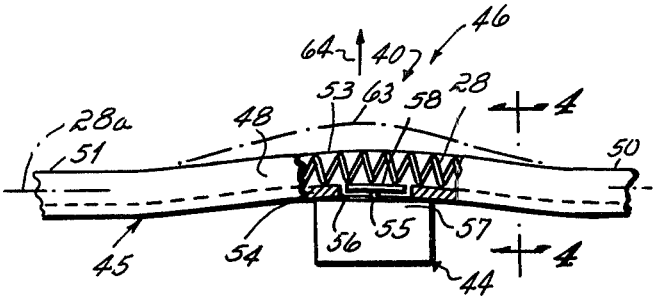
FIG. 3 is an enlarged and more detailed view of the bracketed area 3—3 of FIG. 2.

The sensor 40 component of the lacing wire stop mechanism 10, as shown particularly in FIGS. 2–4, includes a proximity switch 44 that cooperates with a bowed guide element 45 for the lacing wire 28. The bowed guide element 45 is positioned in the lacing wire's path between the lacing coil forming and feeding apparatus 30 and the coil spring assembly's near side 14*a*. The bowed guide element 45 functions to guide the lacing wire 28 across the transition area 46 after it leaves the forming apparatus's outlet 31 until it becomes interconnected with the adjacent spring rows 12, 13. Note particularly the guide element 45 includes an intermediate section that defines a curved or bowed path section 48 which is bowed out of the lacing coil's normally linear axis 28*a*, as well as entry 50 and exit 51 sections that define a linear axis co-axial with the lacing coil's normally linear axis 28*a* and the prospective laced joint's axis 28*a*. The bowed guide element 45, as shown in FIG. 4, is of a channel shaped configuration which is open at convex side wall 53. The proximity switch 44, which includes a compression spring (not shown) loaded plunger 55, is mounted on closed concave side wall 54 of the bowed guide element as shown in FIG. 3. The proximity switch 44 is mounted on that side wall 54 so that plunger 55 extends into the interior of the guide channel through port 56 formed in the side wall. Since the spring loaded plunger 55 is spring loaded away from switch base 57, it's plunger plate 58 remains in continuous contact with the lacing coil 28 as that lacing coil passes through the guide element 45.

In lieu of the contact type of proximity switch 44 a non-contact electro-magnetic or induction type of proximity switch may be used to sense the movement of the lacing wire out of curved bowed path 48 of the guide element 45.

The clamp device 41 includes movable 42 and fixed 43 jaws and feeder switch 34. The movable jaw 41 is driven by a fluid motor 59 that is electrically connected with the feeder switch 34. The feeder switch 34 is mounted to the machine's outer side edge rail 20 in line with the prospective laced joint's axis 28*a*. The bowed guide element 45, as shown in FIG. 5, defines the fixed clamping jaw 43. The clamp's jaws 42, 43 are positioned, as shown in FIGS. 2 and 5, so as to interengage the non-laced or infeed section 65 of the spiral lacing wire 28 in clamping relation when the feeder switch 34 (which is an obstacle) is contacted by the leading end 60 of lacing wire 20. This, of course, occurs only after the spiral lacing wire 20 has traversed the entire width of the spring assembly so that adjacent spring rows 12, 13 are properly and completely laced or ties together. Note particularly that the clamp device 41 is positioned immediately adjacent to inner side edge 14*a* of the spring assembly 14. The clamp device 41 also cooperates with cut off knife 61 for the lacing wire 20 as explained in detail below.

The sensor 40, lacing coil forming and feeding apparatus 30, and clamp device 41 are all connected together in an electrical circuit (not shown) so that the clamp device can grab or clamp the lacing wire 28, when the lacing wire reaches its end of travel and contacts feeder switch 34. It is to be understood that an identical sensor and clamp structure (not shown) functions to perform these operations for the upper lacing wire 26 formed by the upper apparatus 30*a*.

In operation, and as the spiral lacing wires 26, 28 proceed from the lacing coil forming apparatus 30 into spiral lacing relation with opposed Z-shaped connector loops 22, 23 of adjacent continuous spring rows 12, 13 without any hang up or hindrance, the lacing coil forming apparatus 30 continues to coil and to feed out the spiral lacing wires. But if the lead end 60 of a lacing wire gets hung up for any reason as it passes through the clamping dies, then that section of the lacing coil without the bowed guide element 45 (i.e., that section between the lacing coil forming and feeding apparatus 30 and the near edge 14*a* of the coil spring assembly 14) tends to bow out or jump out or pop out of the guide element into and beyond the position shown by phantom line 63 in FIG. 3. This for the reason that the spiral lacing coil is preliminary bowed as it passes through the bowed guide element 45 due to the bowed configuration of that guide element, and any torque build up in the lacing wires because the front end 60 has hit an obstacle induces the wire to jump out of the bowed guide element channel in that direction 64 of the prebowed condition.

When the spiral lacing wire bows outwardly from the bowed guide element into or beyond phantom line 63 position, the sensor's proximity switch 44 is activated. And when the sensor's proximity switch 44 is activated, the electric circuitry (not shown) causes the lacing coil forming and feeding apparatus 30 to be cut off or stopped through use of a brake mechanism (not shown) that is part of that forming apparatus, thereby stopping the feeding apparatus 30 until the hang up or obstacle can be eliminated.

If the spiral lacing wire simply has traversed the assembly's entire width until end 60 abuts feeder switch 34 on machine rail 20, then contact of the lacing wire's lead end 60 with feeder switch 34 activates the clamp device 41. When the clamp device 41 is activated, the spiral lacing wire section 65 adjacent to the assembly's near edge 14*a* is clamped between the clamp's jaws 42, 43. Subsequently, a cut off mechanism (illustrated diagrammatically by cut off knife 61) is activated to cut the lacing wire preparatory to indexing a subsequent next spring row (not shown) into lacing proximity with the dies. After the spiral lacing wire is cut off to the desired length, the clamp device 14 prevents that lacing wire section 65 not laced with the spring assembly 14 from springing forward and winding itself into the coil spring assembly (due to built up torque in that lacing wire section as provided by the forming apparatus) until the assembly has been indexed in the machine direction 17 and the dies closed. Of course, once the spring assembly has been indexed one row in the machine direction 17, the clamp jaws 42, 43 may be released, and the lacing wire forming and feeding apparatus 30 once again activated to feed lacing wires 26, 28 into the spring assembly for lacing together a new spring row positioned against the leading spring row 12.

While I have described in detail the preferred embodiment of my invention, persons skilled in the art will appreciate changes and modifications which may be made without departing from the spirit of my invention. For example, such persons will appreciate that this invention is applicable to machines for lacing border wires and end coils of coil springs as well as to machines for lacing together juxtaposed end coils of different springs. Therefore, I do not intend to be limited except by the scope of the appended claims.

I claim:

1. Coil spring assembly apparatus for lacing coil spring end loops together to form a coil spring assembly, said apparatus comprising lacing wire feeding apparatus adapted to feed a spiral lacing wire along a linear axis into lacing relation with adjacent coil spring end loops in adjacent coil spring rows to form said coil spring assembly, a lacing wire stop mechanism comprising a guide element interposed between said lacing wire feeding apparatus and said coil spring rows for guiding said spiral lacing wire from said feeding apparatus into lacing relation with said adjacent spring rows, said guide element having a guide section through which said spiral lacing wire is guided, said guide section defining a normal path of travel of said spiral lacing wire which is bowed out of axial linearity with said lacing wire as it moves between said feeding apparatus and said spring assembly, and said lacing wire normally being in contact with and guided by said bowed guide section so as to establish a continuous bowed configuration of said lacing wire within said bowed guide section as said lacing wire laces adjacent coil spring rows together, and sensing means operatively connected with said guide element and with said lacing wire feeding apparatus, said sensing means being operative to sense when said lacing wire bows outwardly away from said normal bowed path of travel defined by said guide element's guide section in response to an obstacle encountered by the leading end of said lacing wire as said lacing wire is being wound in lacing fashion about the coil spring end loops, said feeding apparatus being stopped in response to the sensing of said obstacle.

2. Coil spring assembly apparatus of claim 1, said sensing means comprising an electrical proximity switch operative to switch off said lacing wire feeding apparatus in response to engagement of the leading edge of said lacing wire with an obstacle.

3. Coil spring assembly apparatus of claim 2, said proximity switch comprising a spring loaded plunger movable relative to a base, said lacing wire being in contact with said plunger during normal operation as said lacing wire traverses said bowed path, but said lacing wire being induced to move away from said plunger as said lacing wire bows outwardly away from said bowed path in response to an obstacle encountered by the leading end of said lacing wire.

4. Coil spring lacing apparatus as set forth in claim 1, said apparatus further comprising first and second clamp jaws positioned between said feeding apparatus and that side edge of said coil spring rows adjacent thereto, at least one of said clamp jaws being movable relative to the other of said clamp jaws, and said clamp jaws functioning to clamp said helical lacing wire therebetween.

5. Coil spring lacing apparatus as set forth in claim 4, said apparatus further comprising a knife positioned to sever said spiral lacing wire adjacent a side edge of said coil spring assembly, said clamp jaws cooperating to prevent that lacing wire end not laced with said spring rows from springing forward and then winding itself into said spring assembly after said knife has severed said spiral lacing wire at said one edge.

6. A lacing wire stop mechanism for use in producing a coil spring assembly, said mechanism comprising lacing wire feeding apparatus adapted to feed a spiral lacing wire into lacing relation with juxtaposed spring end loops of adjacent spring rows, a sensor that functions to sense when a helical lacing wire has finished tying together said juxtaposed spring end loops of adjacent spring rows, knife means positioned to sever said spiral lacing wire at that side edge of said coil spring rows which is adjacent to said feeding apparatus, and first and second clamp jaws positioned between said feeding apparatus and that side edge of said coil spring rows adjacent thereto, at least one of said clamp jaws being movable relative to the other of said clamp jaws, said clamp jaws functioning to clamp a non-laced section of said helical lacing wire therebetween after said lacing wire has finished tying together said adjacent spring rows as sensed by said sensor, said non-laced section being adjacent to the lacing wire infeed end of said spring rows, and said clamp jaws cooperating to prevent that lacing wire end not laced with said spring rows from springing forward and then winding itself into said spring assembly after said knife means has severed said spiral lacing wire at said one edge.

7. A lacing wire stop mechanism as set forth in claim 6, said sensor comprising a switch positioned to be activated by the lead end of said lacing wire after said lacing wire has tied together completely said spring rows, said switch being connected with and adapted to activate said clamp jaws.

8. A lacing wire stop mechanism as set forth in claim 6, said mechanism comprising a bowed guide element interposed between said lacing wire feeding apparatus and said adjacent coil spring rows for guiding a spiral lacing wire from said feeding apparatus into lacing relation with said adjacent spring rows, said guide element having a section through which said spiral lacing wire is guided, said section defining a bowed path which is bowed out of axial linearity with said lacing wire as it moves between said feeding apparatus and said spring assembly.

9. A lacing wire stop mechanism as set forth in claim 8, said mechanism comprising a switch operatively connected with said guide element and said feeding apparatus, said switch sensing when said lacing wire moves outwardly away from the bowed path defined by said guide element's guide section, said switch being adapted to stop said feeding apparatus upon said switch sensing outwardly movement of said lacing wire.

10. An improved lacing wire stop mechanism as set forth in claim 9, said switch comprising a spring loaded plunger connected to a base, said lacing wire being normally in contact with said plunger when said lacing wire is being wound in lacing fashion about the juxtaposed spring end loops of adjacent spring rows, but said lacing wire being induced to move away from said plunger as it moves away from said bowed path when the leading end of said lacing wire encounters an obstacle while being wound in lacing fashion about the juxtaposed spring end loops of adjacent spring rows.

11. Coil spring assembly apparatus for lacing coil spring end loops together to form a coil spring assembly, said apparatus comprising lacing wire feeding apparatus adapted to feed a spiral lacing wire along a linear axis into lacing relation with adjacent coil spring end loops in adjacent coil spring rows to form said coil spring assembly, a guide element interposed between said lacing wire feeding apparatus and said coil spring rows for guiding said spiral lacing wire from said feeding apparatus into lacing relation with said adjacent spring rows, said guide element having a guide section through which said spiral lacing wire is guided, said guide section defining a normal path of travel of said spiral lacing wire which is bowed out of axial linearity with said lacing wire as it moves between said feeding apparatus and said spring assembly, and said lacing wire normally being in contact with and guided by said bowed guide section so as to establish a continuous bowed configuration of said lacing wire within said bowed guide section as said lacing wire laces adjacent coil spring rows together, first sensing means operatively connected with said guide element and with said lacing wire feeding apparatus, said sensing means being operative to sense when said lacing wire bows outwardly away from said normal bowed path of travel defined by said guide element's guide section in response to an obstacle encountered by the leading end of said lacing wire as said lacing wire is being wound in lacing fashion about the coil spring end loops, said feeding apparatus being stopped in response to the sensing of said obstacle, second sensing means that functions to sense when a helical lacing wire has finished tying together said juxtaposed spring end loops of adjacent spring rows, knife means positioned to sever said spiral lacing wire at that side edge of said coil spring rows which is adjacent to said feeding apparatus, and first and second clamp jaws positioned between said feeding apparatus and that side edge of said coil spring rows adjacent thereto, at least one of said clamp jaws being movable relative to the other of said clamp jaws, said clamp jaws functioning to clamp a non-laced section of said helical lacing wire therebetween after said lacing wire has finished tying together said adjacent spring rows as sensed by said second sensing means, said non-laced section being adjacent to the lacing wire infeed end of said spring rows, and said clamp jaws cooperating to prevent that lacing wire end not laced with said spring rows from springing forward and then winding itself into said spring assembly after said knife means has severed said spiral lacing wire at said one edge.

12. Coil spring assembly apparatus of claim 11, said first sensing means comprising an electrical proximity switch operative to switch off said lacing wire feeding apparatus in response to engagement of the leading edge of said lacing wire with an obstacle.

13. Coil spring assembly apparatus of claim 12, said proximity switch comprising a spring loaded plunger movable relative to a base, said lacing wire being in contact with said plunger during normal operation as said lacing wire traverses said bowed path, but said lacing wire being induced to move away from said plunger as said lacing wire bows outwardly away from said bowed path in response to an obstacle encountered by the leading end of said lacing wire.

14. Coil spring assembly apparatus of claim 11, said second sensing means comprising a switch positioned to be activated by the lead end of said lacing wire after said lacing wire has tied together completely said spring rows, said switch being connected with and adapted to activate said clamp jaws.

* * * * *

UNITED STATES PATENT AND TRADEMARK OFFICE

CERTIFICATE OF CORRECTION

PATENT NO. : 4,445,547

DATED : May 1, 1984

INVENTOR(S) : Terry L. Aronson

It is certified that error appears in the above-identified patent and that said Letters Patent is hereby corrected as shown below:

Column 6, lines 13 and 14, "without" should be -- within --

Signed and Sealed this

*Twenty-sixth* Day of *March 1985*

[SEAL]

*Attest:*

DONALD J. QUIGG

*Attesting Officer*

*Acting Commissioner of Patents and Trademarks*